United States Patent [19]

Thackeray

[11] Patent Number: 4,726,780

[45] Date of Patent: Feb. 23, 1988

[54] TWIST-LOCK FEMALE PLUG ADAPTER

[76] Inventor: Michael Thackeray, 2380 Stafford Rd., Thousand Oak, Calif. 91361

[21] Appl. No.: 909,209

[22] Filed: Sep. 19, 1986

[51] Int. Cl.[4] ..... H01R 27/00; H01R 13/58

[52] U.S. Cl. ..... 439/223; 439/369; 439/135

[58] Field of Search ..... 339/31 R, 31 M, 32 R, 339/33, 88, 189, 36, 41, 75 P; 439/518, 217, 673, 674, 135, 296, 177, 516, 339, 137, 223, 222, 224, 369

[56] References Cited

U.S. PATENT DOCUMENTS

| | | | |
|---|---|---|---|
| 1,512,203 | 10/1924 | De Reamer | 339/33 |
| 2,252,454 | 8/1941 | Benander | 339/33 |
| 2,436,217 | 2/1948 | Locktov | 339/33 |
| 3,113,174 | 12/1963 | Spiteri | 339/36 |
| 3,676,829 | 7/1972 | Gartland, Jr. et al. | 339/33 |
| 4,204,738 | 5/1980 | Fillotson | 339/75 P |
| 4,241,969 | 12/1980 | D'Amato et al. | 339/88 R |
| 4,643,505 | 2/1987 | House et al. | 339/75 P |

FOREIGN PATENT DOCUMENTS

| | | | |
|---|---|---|---|
| 362533 | 12/1931 | United Kingdom | 339/33 |

*Primary Examiner*—Gil Weidenfeld
*Assistant Examiner*—Daniel W. Howell
*Attorney, Agent, or Firm*—Milton S. Gerstein

[57] ABSTRACT

An adapter for a twist-lock extension cord in which the adapter replaces the female plug-end of the extension cord. The adapter has a face plate in which are formed three curved cutouts for receiving the three curved electrodes of a twist-lock male plug. There are also provided on the face plate two straight cutouts for receiving the two electrodes of a standard household male plug. One of the curved cutouts is ground, and also receives the ground of the standard household-type male plug. Three terminals are provided, one associated with the ground cutout, and each of the other two associated with a pair of one curved and one straight cutout. A clamp secures the exposed wires of the extension cord to the adapter for connection to the terminals, thereby converting the extension cord to one that receives not only twist-lock male plugs but also standard household-type male plugs.

15 Claims, 23 Drawing Figures

Fig.1.
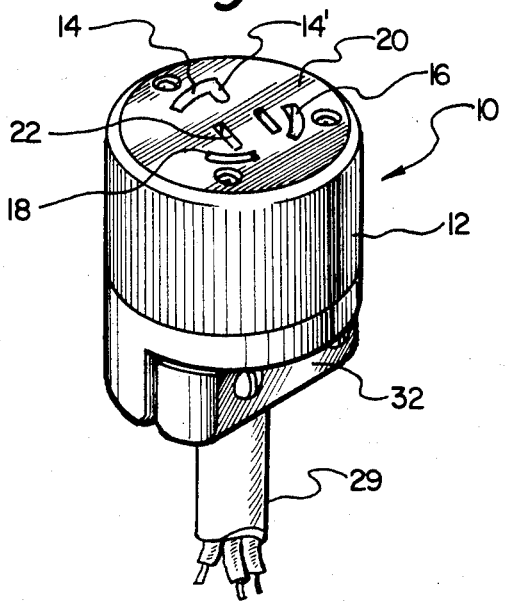
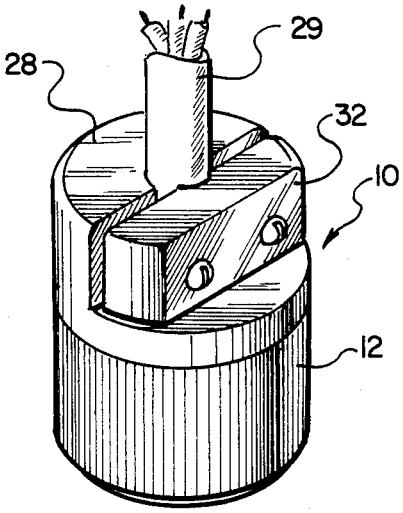
Fig.2.
Fig.3.
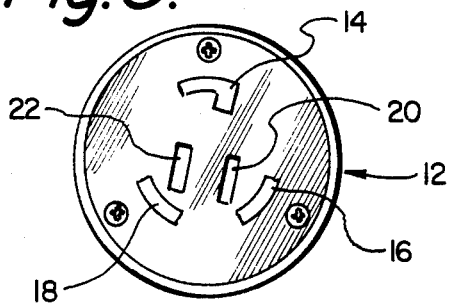
Fig.4.
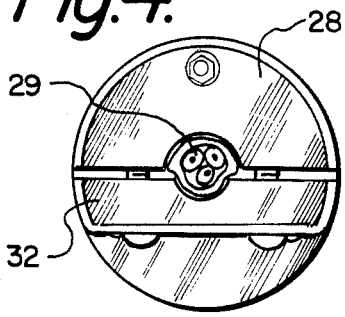
Fig.5.
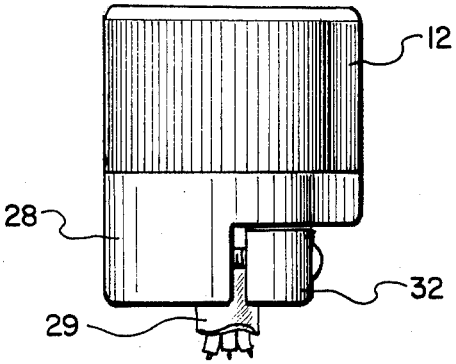
Fig.6.
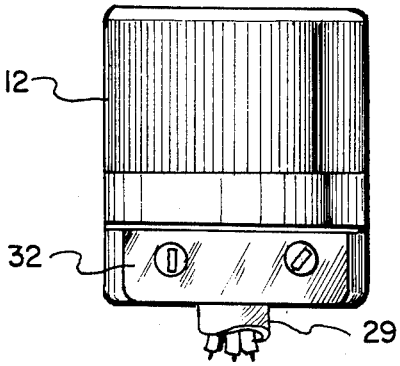

TWIST-LOCK FEMALE PLUG ADAPTER

BACKGROUND OF THE INVENTION

The present invention is directed to an adapter for a twist-lock extension cord, and the like, which extension cord has at one thereof a female plug-end for reception of a male plug-end of an adapter, or the male end of a power tool-cord. Twist-lock extension cords are typically used at construction sites for tools, to ensure that the male plug of the tool-cord cannot accidentally come loose and disconnect. This is achieved by the provision of an offset portion for each one of the three plug-electrodes of the male plug-end of the cord of the power tool. The offset portion of the projections or electrodes of the male plug prevents removal of the male plug from the associated mating female plug-end of the twist-lock extension cord, which is accomplished by simply rotating the male plug in a direction to cause the offset portions to become positioned behind a cooperating member of the cover in which are formed the corresponding openings of the female plug-end of the extension cord through which are inserted and similarly-shaped electrodes of the male plug. Thus, by rotating, or twisting, the male plug, the offset portions of the electrodes are moved behind the members, and thus serve as stops to the removal of the male plug from the female plug of the twist-lock extension cord.

Twist-lock adapters are also available to allow use of a power tool with the twist-lock extension cord if the power tool is not equipped with the twist-lock type of male plug end. The problems with these adapters are that they are removably coupled to the female-end of the extension cord, and thus are are easily lost or stolen, which is commonplace, since these twist-lock adapters are not inexpensive.

SUMMARY OF THE INVENTION

It is, therefore, the primary objective of the present invention to provide an adapter that is fixedly connected to, and replaces the female plug-end of, a conventional twist-lock extension cord, which adapter allows for both three-electrode male plugs of the conventional type, three-electrode male plugs of the twist-lock type, and conventional two-electrode male plugs to be accomodated and coupled to the extension cord by the very same structure.

It is also an objective of the present invention to eliminate entirely the need for a separate twist-lock adapter, as has been hithertofore necessary.

It is another objective of the present invention to provide an adapter for a female end of an twist-lock extension cord that is clamped to the extension cord, and which helps to prevent the theft and loss thereof.

It is yet another objective of the present invention to provide an adapter for a twist-lock extension cord that allows ease of installation to the end of a conventional extension cord, and that will be applicable to both 110 V and 220 V applications.

Toward these and other ends, the adapter for the female end of a twist-lock extension cord is provided with a main housing in which are mounted three terminals, forming the ground, neutral, and power terminals. Each of the neutral and power terminals has an opening shaped for receiving a projection or electrode of a male plug of the curved type, provided with twist-lock male plugs having three electrodes, one of which is ground, and also for receiving a projection or electrode of a male plug of the straight type, provided with common household male plugs having two straight electrodes and a ground electrode. Thus, each of the neutral and power terminals of the adapter of the invention has an opening that includes a first straight portion parallel to the straight portion of the other of the neutral and power terminals, as well as a curved portion extending at an acute angle with respect to the straight portion of the respective terminal, so that the straight-type electrode and curved-type electrode, respectively, may be accomodated in the neutral or power terminal, thereby allowing the extension cord to be used with both three-electrode twist-lock curved type and three-electrode straight type of male plugs. The ground terminal of the adapter of the invention has an opening that is substantially L-shaped to correspond with the shape of the ground electrode of twist-lock type of male plugs, which also allows for passage therethrough of the conventional household ground electrode. The ground terminal has a projecting portion that projects beneath the shorter leg portion of the L-shaped ground opening formed in the main housing, so that the ground electrode of the conventional household male plug may be in contact with the ground terminal and connected to the the ground wire of the twist-lock extension cord. A clamp holds the extension cord in place for fixed connection of the three wires thereof to the respective terminals.

BRIEF DESCRIPTION OF THE DRAWING

The invention will be more readily understood with reference to the accompanying drawing, wherein FIG. 1 is top perspective view of the twist-lock adapter of the present invention;

FIG. 2 is a bottom perspective view of the twist-lock adapter of the present invention;

FIG. 3 is a top view of the twist-lock adapter of FIG. 1;

FIG. 4 is a bottom view of the twist-lock adapter of FIG. 1;

FIG. 5 is a side elevational view of the twist-lock adapter of FIG. ;

FIG. 6 is a front elevational view of the twist-lock adapter of FIG. 1;

DETAILED DESCRIPTION OF THE INVENTION

Figure 7:
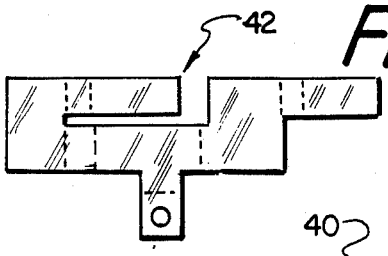
FIG. 7 is a plan view showing the blank from which the neutral and power terminals are formed.

Referring now to the drawings in greater detail, the twist-lock adapter for the female end of a twist-lock extension cord is indicated generally by reference numeral 10. The adapter 10 includes a top face plate 12 in which are provided five separate and distinctly shaped through-openings 14, 16, 18, 20 and 22, as seen in FIGS. 1, 5, 18 and 21. The three outer through-openings 14, 16 and 18 which are curved, correspond to the shapes of the three elecrodes of the conventional twist-lock male plug, with the opening 14 being for the ground electrode, the opening 16 being for the power electrode, and the opening 18 being for the neutral electrode. The curved opening 18 is slightly longer than the curved opening 16 in order to match the slightly longer length of the neutral electrode of the conventional twist-lock male plug. The face plate 12 includes associated stop members on the interior thereof for preventing the removal of the male plug after it has been inserted and very slightly rotated to bring the offset portions of the electrodes directly under the associated stop members, in a conventional manner. Since this does not constitute part of the invention, and is well-known, the details thereof have not been shown in the drawings. The two center, straight openings 20 and 22 accept the two straight prongs or electrodes of a conventional household male plug, whether three prong or two prong. If the conventional household plug has three electrodes, one of which is ground, the bent portion 14' of the curved opening 14 accepts the straight ground electrode for connection to the ground terminal in the manner described below.

Figure 18:
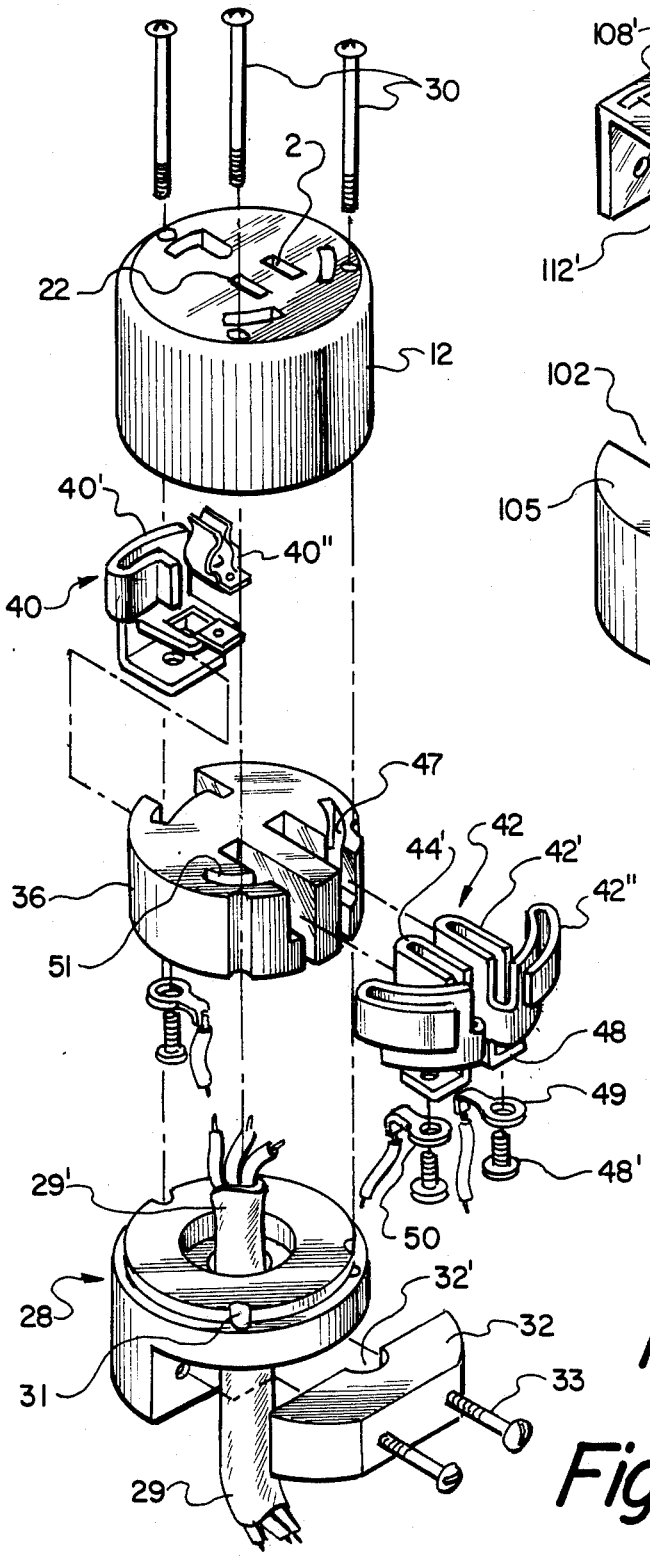
FIG. 18 is an assembly view showing the parts of the twist-lock adapter of the invention and their manner of assembly.

The face plate itself is connected to a base member 28 shown in FIGS. 1, 2, 5 and 6, and best seen in FIG. 18. The base member 28 includes a central hole for the passage therethrough of the bared end 29' of the cord 29 of the conventional twist-lock extension cord to which the adapter 10 is to be attached for replacing the female end of the cord thereof. The face plate 12 is secured to the base member via screws 30 that are received in holes 31 formed about the circumference of the base member, as best seen in FIG. 18. The end 29' of the cord 29, from which the female end of the extension cord has been cut to thus form the bared wires of the end 29', is clamped to the base member 28 for secured holding thereby via a clamping bracket 32 having a central, semi-circular cutout 32' for receiving a portion of the cord 29 therein, so that the exposed end 29' of the cord is situated above the upper surface of the base member 28, for electrical connection with the respective terminals of the adapter 10 described below. Screws 33 secure the clamping bracket to the base member 28 to thereby clamp the cord.

The adapter 10 also includes a center, insulating mounting plate 36 best seen in FIG. 18. The mounting plate 36 is made of any suitable plastic and mounts the three terminals of the adapter: ground terminal 40, power terminal 42, and neutral terminal 44. Each of the terminals 42 and 44 is the same, except that one is the mirror-image of the other. The terminal 42, includes a straight receptacle-portion 42' for receiving the straight power electrode of a conventional household male plug, and a curved receptacle-portion 42'' for receiving therethrough the curved and similarly-shaped power electrode of the conventional twist-lock male plug. The terminal 42 is made of copper, or the like, and is mounted in the associated cutout 47 of the mounting plate either by force-fit, or by bracket 48 and screw 48', and is made resilient enough with its receptacle-openings of snug size so as receive the electrode therein for contact. The exposed end of the power-wire of the cord 29 is then connected to the terminal 42 via ear 49 by any conventional manner, or may be wound about the screw 48' and tightened thereby.

The terminal 44, shown in detail in FIGS. 9–13, is identical in construction to the terminal 42, except for its being the mirror-image of the terminal 42, and for the fact that the length of the curved receptacle portion 44'' is somewhat longer than the portion 42'' of the terminal 42, in order to accomodate the wider curved portion of the neutral electrode of the conventional twist-lock male plug. The straight receptacle portion 44' is identical to the straight receptacle portion 42'. The bared end of the neutral wire of the cord 29 is secured to the terminal 44 via another ear 50. The terminal 44 is received in the associated cutout 51 of the insulating mounting plate 36.

Figure 15:
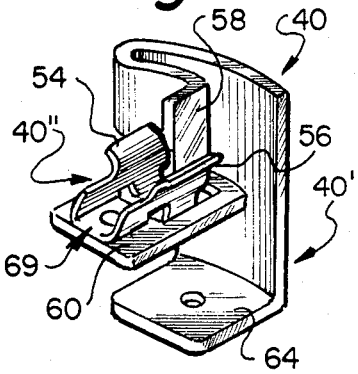
FIG. 15 is a perspective view of the ground terminal of FIG. 14.
Figure 16:
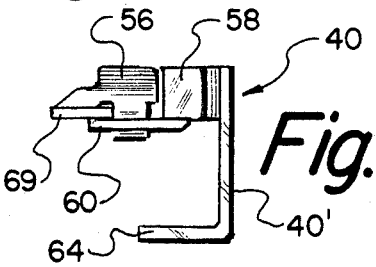
FIG. 16 is a side elevational view of the ground terminal of FIG. 14.
Figure 17:
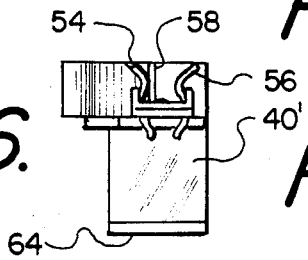
FIG. 17 is a front elevational view of the ground terminal of FIG. 14.

The ground terminal 40 is shaped to correspond to the shape of the ground electrode of a conventional twist-lock male plug, while at the same allow reception of the conventional straight ground electrode of a household male plug. The ground terminal includes a first part 40' having a curved receptacle-portion, and a second part 40'' defining a substantially straight receptacle-portion, both of which parts are best seen in FIGS. 15–17. The second part 40'' has a pair of diverging fingers 54 and 56 that are resilient and grip straight ground electrode of a conventional household male plug therebetween. The perpendicular lip 58 of the first part 40' is positioned such that the right-angle portion of the conventional ground electrode of the twist-lock male plug may be accomodated. The second part 40'' has a bracket mount 60 for fixed and permanent connection to the edge of the lip 58. This bracket mount 60 is open through the middle thereof to allow for passage of the straight ground electrode of the household-plug type therethrough. A lower protruding mounting bracket 64 of the first part 40' is also provided for fixedly mounting the entire ground terminal 40 to the insulating mounting plate 36, as seen in FIG. 18. In the preferred construction, the fingers 54 and 56 are provided as one unit 69 and connected to the bracket 60, as best seen FIGS. 15 and 18, by a screw, or the like. The piece 69 is provided with a hole in the center thereof between the two fingers to allow for passage of the straight ground electrode therethrough and thence through the opening in the bracket 60.

Figure 14:
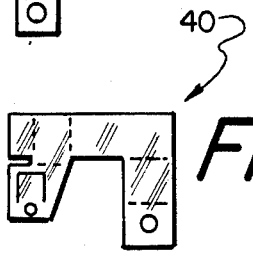
FIG. 14 is a plan view showing the blank from which is formed the ground terminal of the twist-lock adapter of the invention.
Figure 8:
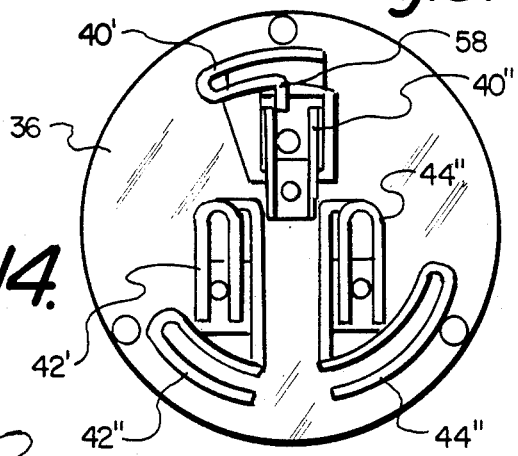
FIG. 8 is a bottom view of the plastic housing mounting the terminals of the twist-lock adapter of FIG. 1.
Figure 9:
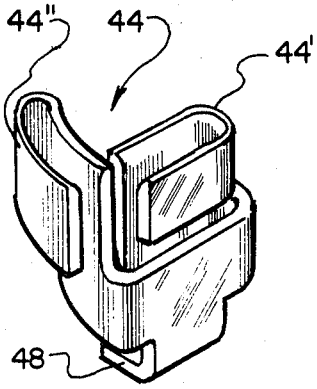
FIG. 9 is a perspective view of the neutral or power terminal of the twist-lock of FIG. 1.
Figure 10:
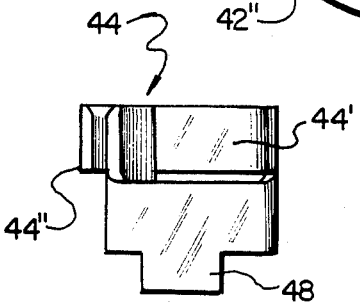
FIG. 10 is a front elevational view of the terminal of FIG. 9.
Figure 11:
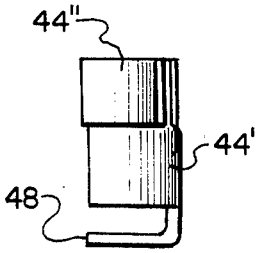
FIG. 11 is a side elevational view of the terminal of FIG. 9.
Figure 12:
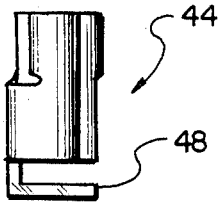
FIG. 12 is another side elevational view of the terminal of FIG. 9.
Figure 13:
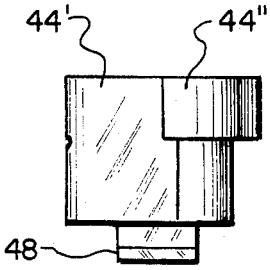
FIG. 13 is a rear elevational view of the terminal of FIG. 9.

FIGS. 7 and 14 show how the power terminal and the ground terminal are formed repsectively, from a blank sheet of copper. The dotted lines show the lines at which the blank is folded to form the terminals of the invention.

The adapter 10 may, therefore, be used to receive conventional twist-lock male plugs, as well as conventional household male plugs of the three-electrode and two-electrode type.

Figure 19:
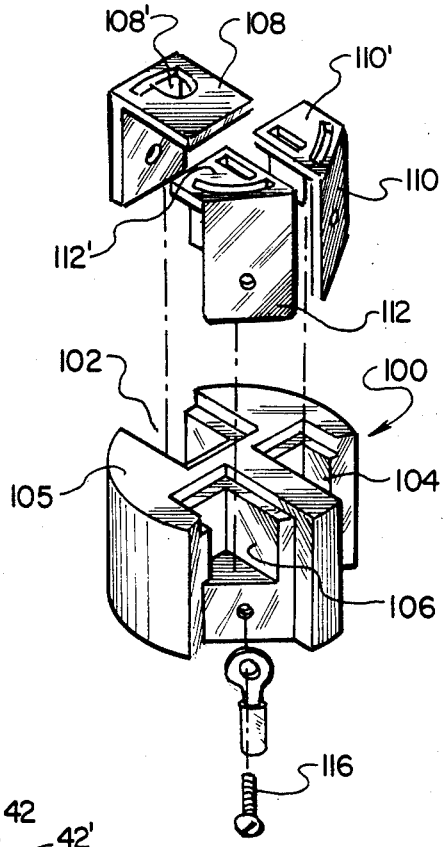
FIG. 19 is an assembly view, in perspective, showing a modification of the housing of the twist-lock adapter of the invention for mounting a modification of the terminals.
Figure 20:
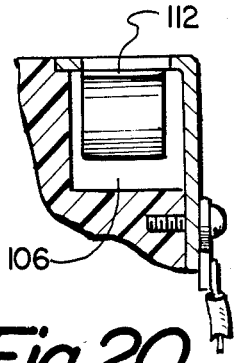
FIG. 20 is a detail view, in cross-section, showing the terminal of FIG. 19 positioned in one of the chambers formed in the main housing.
Figure 21:
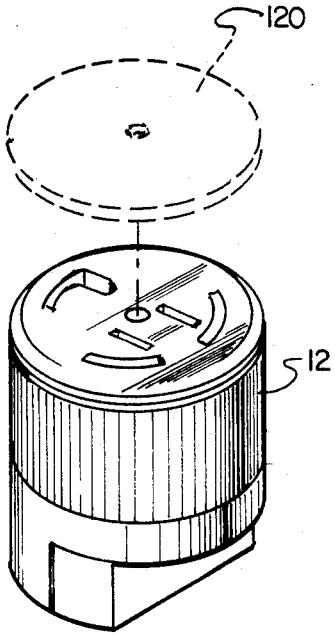
FIG. 21 is an assembly view, in perspective, showing the twist-lock adapter of the invention with a closure disc for alternatively closing off either the two twist-lock neutral and power receptacles formed in the outer casing, or for closing off the two straight receptacles.
Figure 22:
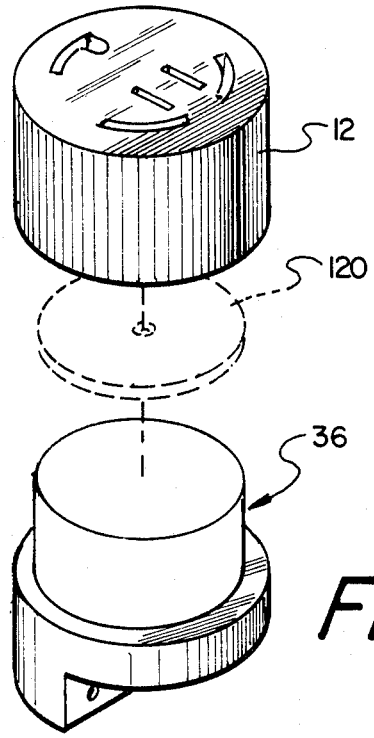
FIG. 22 is a view similar to FIG. 21 but showing the closure disc positioned between the outer casing and the main housing.

FIGS. 19 and 20 show another a manner by which the terminals may be provided. In this embodiment, the insulating mounting plate 100 is provided with a plurality of wells 102, 104 and 106 for receiving the terminals 108, 110 and 112, respectively having the cutouts formed therein on an upper face 108', 110', and 112', respectively. Screws 116 secure the lower extending portions of the terminals to the mounting plate. Each well receives the corresponding terminal such that the upper faces thereof lie substantially in the same plane as the upper face 100' of the mounting plate 100. FIG. 21 shows a closure disc 120 having a plurality of cutouts formed therethrough for alternatively exposing or closing off the openings in the upper face of the face plate, so that when the two curved receptacle-portions of each of the neutral and power terminals are exposed, the two straight receptacle-portions are closed off, so that at any one time either one set or the other may be accessed, in order to prevent wrong insertion. The ground cutout in the face plate is, however, at all times exposed. The disc 120 in FIG. 21 is rotatably mounted on the upper face of the face plate 12, though it may be rotatably mounted on the upper face of the mounting bracket 36, as shown in FIG. 22.

Figure 23:
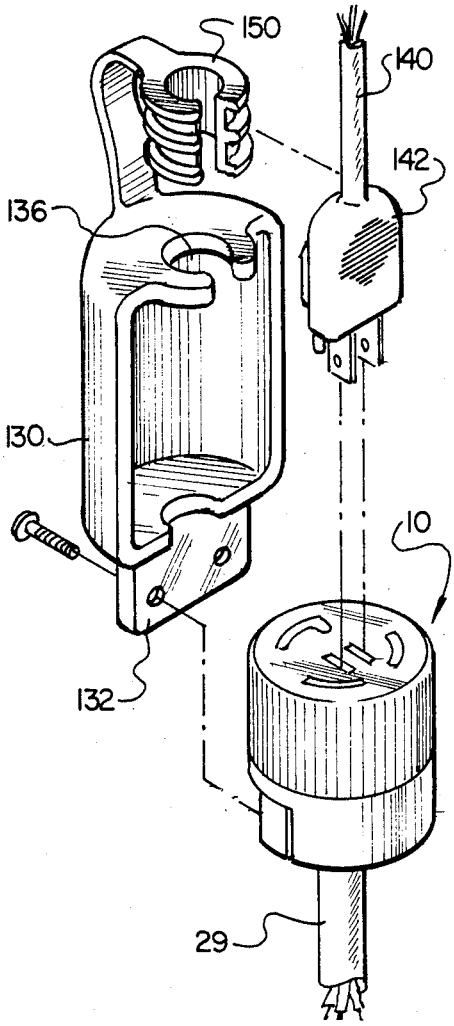
FIG. 23 is an assembly view, in perspective, showing the twist-lock adapter of the invention ready to receive a conventional three-prong househould male plug, along with a locking bracket for preventing the accidental removal of the male plug from the female end of the twist-lock adapter of the invention.

In FIG. 23, there is shown a removal-prevention piece for the male plug after it has been received in the adapter 10. A substantially semi-cylindrical main portion 130 is provided having a lower attaching bracket 132 for securement to the clamping piece 32, on the surface facing away from the cord 29. At the upper end, there is formed an open hole 136 through which passes the cord 140 of a plug received in the adapter 10. Thus, when the male plug 142 is inserted into the adapter 10, the portion 130 is secured to the adapter such that the upper open hole 136 is close to the plug 142, so that if the cord 140 were pulled, the plug 142 would be prevented from being removed from the adapter 10. The extension 150 allows for the cord 140 to be positioned therein, so that forces created by the transverse pulling of the cord to one side or the other will be taken up by the extension 150.

While a specific embodiment of the invention has been shown and described, it is to be understood that numerous changes and modifications may be made therein without departing from the scope, spirit, and intent of the invention as set out in the appended claims.

What is claimed is:

1. An adapter for a twist-lock extension cord, which twist-lock extension cord has a first male plug-end and a second female plug-end, comprising:

a face plate having an outer surface having three angularly spaced-apart curved cutouts formed therethrough, first and second of said three curved cutouts being shaped to correspond to the shapes of the neutral and power electrodes of a twist-lock male plug, and a third of said three curved cutouts having a substantially L-shape for corresponding to the ground electrode of a twist-lock male plug;

said face plate further comprising a pair of parallelly-arranged straight cutouts positioned interiorly of said three curved cutouts such that a circumferential line interconnecting said three curved cutouts surrounds said pair of straight cutouts;

a first terminal means associated with both said first curved cutout and one of said pair of straight cutouts, positioned directly adjacent to said first curved cutout and said one straight cutout;

a second terminal means associated with both said second curved cutout and the other of said pair of straight cutouts, positioned adjacent to said second curved cutout and said other straight cutout;

a third terminal means associated with said third curved cutout and positioned directly adjacent to said third curved cutout;

insulating mounting means for mounting each of said first, second, and third terminal means;

a base member for fixed connection to said face plate, and means for securing said face plate to said base member; and means for clamping exposed ends of wires to said base member, each of said terminal means comprising means for electrically connecting a respective wire to the respective terminal;

each of said first and second terminal means comprising a first curved receptacle-portion for the insertion therein of a curved electrode of a twist-lock male plug, and a second substantially non-curved receptacle portion for the insertion therein of a neutral and power electrodes of a household-type male plug, said first curved receptacle-portion extending at an acute angle with respect to said second non-curved receptacle portion, each of said first and second receptacle-portions providing a through-opening;

said third terminal means being substantially L-shaped and having a first curved portion and a second portion thereof extending from said first portion, said second portion being substantially parallel with said second receptacle portions of said first and second terminal means, said second portion of said third terminal means being positioned between said second receptacle portions so that said second portion may be used for both twist-lock ground electrode and conventional ground electrodes;

said insulating mounting means comprising a first mounting opening for receiving therein said first terminal means, and a second mounting opening for receiving therein said second terminal means, each of said first and second mounting openings defining a shape similar to the shape of said first and second receptacle-portions for receiving therein said first and second receptacle-portions;

each of said first and second terminal means being one integral unit, said first curved receptacle-portion of each said first and second terminal means being integrally connected with said substantially non-curved receptacle portion of the respective said first and second terminal means, whereby each said first and second terminal means may be easily installed in the respective said mounting opening and easily removed therefrom as one integral unit.

2. The adapter according to claim 1, wherein said first mounting opening is the mirror-image of said second mounting opening, so that said second non-curved receptacle-portion of each of said first and second terminal means are directly parallel to each other, and said first curved receptacle-portion of each of said first and second terminal means project away from each other from the side of the respective second non-curved receptacle-portion facing away from the other of said first and second terminal means.

3. The adapter according to claim 1, wherein said mounting means further comprises a third mounting opening of substantial L-shaped cross section, said third terminal means being a ground terminal and comprising a first curved receptacle-portion, and a second relatuvely non-curved receptacle-portion, said second receptacle-portion having a first open end in communication with an open end of said first receptacle-portion to form said L-shaped cross section.

4. The adapter according to claim 3, wherein said first receptacle-portion comprises a mounting bracket for attaching said third terminal means to said insulating mounting means, said mounting bracket overlapping the bottom surface of said insulating mounting bracket and secured thereto.

5. The adapter according to claim 3, wherein said first receptacle-portion comprises a pair of substantially-parallel curved side walls, and an end wall joining opposing ends of said side walls, one said side wall being shorter in length than the other said side wall and having a bent lip thereat projecting away from said other side wall to define said open end of said first receptacle-portion which receives the offset portion of a twist-lock type ground electrode.

6. The adapter according to claim 5, wherein said second receptacle-portion comprises a base portion for fixed connection with said bent lip of said first receptacle-portion; said second receptacle-portion also comprising a pair of similar and spaced-apart finger-members defining therebetween an open area through which projects the ground electrode of a household-type male plug; the bottom edge surfaces of said finger-members being joined to said base portion of said second receptacle-portion, said base member also having a through-opening formed therein for alignment with the space between said finger-members so that the ground electrode may project entirely through; said finger-members being resilient and providing a snug fit for the ground electrode to effect electrical contact therebetween.

7. The adapter according to claim 1, wherein said means for clamping comprises a clamping plate having an inner, substantially-straight edge surface, said edge surface being formed with a depression at a midportion thereof in which is received a portion of a twist-lock type of extension cord, and means for securing said edge surface to said base member for sandwiching therebetween the portion of the extension cord.

8. The adapter according to claim 1, further comprising means for preventing the accidental removal of a male plug from said face plate after the electrodes thereof have been received in said cutouts thereof.

9. The adapter according to claim 8, wherein said means for preventing comprises a semi-cylindrical hollow main body portion, and an upper open hole through which extends the cord of the male plug; and means for fastening said hollow main body portion to at least one of the base member and face plate; said open hole being in close proximity to the plug and having a diametric extension less than any major measurement of the plug to prevent the accidental pulling of the plug from the adapter.

10. The adapter according to claim 9, wherein said main body portion further comprises an upwardly-extending transverse-force absorbing member projecting above said open hole, and comprises a hollow member with inlet means for allowing the cord of the male plug to enter therein.

11. The adapter according to claim 1, further comprising rotatable disc means for alternatively closing off said first and second curved cutouts and exposing said pair of straight cutouts, and for closing off said pair of straight cutouts and exposing said three curved cutouts; said rotatable disc means comprising a disc having a first pair of curved cutouts similar to said first and second curved cutouts, and a second pair of straight cutouts similar to said pair of straight cutouts; and means for rotatably mounting said disc to one of said face plate and base member.

12. The adapter according to claim 1, in combination with a twist-lock extension cord, said adapter being fixedly coupled by said means for clamping to said extension cord and forming the female plug-end of said extension cord.

13. An adapter for a twist-lock extension cord, which twist-lock extension cord has a first male plug-end and a second female plug-end, comprising:

a face plate having an outer surface having three angularly spaced-apart curved cutouts formed therethrough, first and second of said three curved cutouts being shaped to correspond to the shapes of the neutral and power electrodes of a twist-lock male plug, and a third of said three curved cutouts having a substantially L-shape for corresponding to the ground electrode of a twist-lock male plug;

said face plate further comprising a pair of parallelly-arranged straight cutouts positioned interiorly of said three curved cutouts such that a circumferential line interconnecting said three curved cutouts surrounds said pair of straight cutouts;

a first terminal means associated with both said first curved cutout and one of said pair of straight cutouts, positioned directly adjacent to said first curved cutout and said one straight cutout;

a second terminal means associated with both said second curved cutout and the other of said pair of straight cutouts, positioned adjacent to said second curved cutout and said other straight cutout;

a third terminal means associated with said third curved cutout and positioned directly adjacent to said third curved cutout;

insulating mounting means for mounting each of said first, second, and third terminal means;

a base member for fixed connection to said face plate, and means for securing said face plate to said base member; and means for clamping exposed ends of wires to said base member, each of said terminal means comprising means for electrically connecting a respective wire to the respective terminal;

said third terminal means being a ground terminal and comprising a first receptacle-portion having a pair of substantially-parallel curved side walls and an end wall joining opposing ends of said side walls, one of said side walls being shorter in length than the other said side wall and having a bent lip thereat projecting away from said other side wall to define an open end of said first receptacle portion which received the offset portion of a twist-lock type ground electrode, and a second relatively non-curved receptacle portion having a first open in communication with said open end of said first receotacle-portion.

14. The adapter according to claim 13, wherein said second receptacle-portion comprises a base portion for fixed connection with said bent lip of said first receptacle-portion, said second receptacle-portion also comprising a pair of similar and spaced-apart finger-members defining therebetween an open area through which projects the ground electrode of a household-type male plug, the bottom edge surfaces of said fingers being joined to said base portion of said second receptacle-portion, said base member also having a through-opening formed therein for alignment with the space between said finger-members so that the ground electrode may project entirely through, said finger-members being resilient and providing a snug fit for the ground-electrode to effect electrical contact therebetween.

15. An adapter for an extension cord, comprising:

a face plate having an outer surface having cutouts formed therethrough for the insertion therein of electrodes of a plug;

terminal means associated with said cutouts;

insulating mounting means for mounting said terminal means adjacent to said cutouts to effect an electrical connection thereby;

a base member mounting said face plate and said insulating mounting means;

means for preventing the accidental removal of a male plug from said face plate after the electrodes have been received in said cutouts;

said means for preventing comprising a hollow main body portion, and an upper open hole through which extends the cord of the male plug, and means for fastening said hollow main body portion to at least one of the base member and face plate, said open hole being in close proximity to the plug and having a diametric extension less than any major measurement of the plug to prevent the accidental pulling of the plug from the adapter;

said main body portion further comprising an upwardly-extending transverse-force absorbing member projecting above said open hole, and comprises a hollow member with inlet means for allowing the cord to the male plug to enter therein.

* * * * *